US009423746B2

(12) United States Patent
Nakayama

(10) Patent No.: US 9,423,746 B2
(45) Date of Patent: Aug. 23, 2016

(54) IMAGE FORMING APPARATUS AND METHOD IN WHICH A DEVELOPER CARRYING MEMBER IS ROTATED FOR A PREDETERMINED TIME DURING A STARTUP OR REMOVAL OPERATION

(71) Applicant: Masayoshi Nakayama, Ibaraki (JP)

(72) Inventor: Masayoshi Nakayama, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/595,297

(22) Filed: Jan. 13, 2015

(65) Prior Publication Data

US 2015/0198909 A1 Jul. 16, 2015

(30) Foreign Application Priority Data

Jan. 16, 2014 (JP) ..... 2014-005705

(51) Int. Cl.
*G03G 15/08* (2006.01)
*G03G 15/00* (2006.01)

(52) U.S. Cl.
CPC ..... *G03G 15/5008* (2013.01); *G03G 15/0806* (2013.01)

(58) Field of Classification Search
CPC ..... G03G 15/06; G03G 15/5012; G03G 15/5008; G03G 15/0806
See application file for complete search history.

(56) References Cited

U.S. PATENT DOCUMENTS

| | | | | |
|---|---|---|---|---|
| 6,157,794 | A * | 12/2000 | Katsumi | G03G 15/0126 399/228 |
| 6,567,625 | B1 * | 5/2003 | Tatematsu | G03G 15/0216 399/115 |
| 7,826,775 | B2 | 11/2010 | Nakayama et al. | |
| 2004/0018026 | A1 * | 1/2004 | Katayanagi | G03G 15/161 399/66 |
| 2010/0040391 | A1 * | 2/2010 | Uno | G03G 21/105 399/53 |
| 2013/0216251 | A1 * | 8/2013 | Watanabe | G03G 21/105 399/53 |
| 2013/0272751 | A1 * | 10/2013 | Eiki | G03G 15/0808 399/273 |

FOREIGN PATENT DOCUMENTS

| | | | |
|---|---|---|---|
| JP | 02244165 | A * | 9/1990 |
| JP | 09197917 | A * | 7/1997 |
| JP | 2001-209277 | | 8/2001 |
| JP | 2003-091159 | | 3/2003 |
| JP | 2008-256813 | | 10/2008 |
| JP | 2010-243893 | | 10/2010 |

* cited by examiner

*Primary Examiner* — Billy Lactaoen
*Assistant Examiner* — Arlene Heredia Ocasio
(74) *Attorney, Agent, or Firm* — IPUSA, PLLC

(57) ABSTRACT

An image forming apparatus includes a latent image bearer that carries a latent image and a developer carrier including a developer carrying member that carries a developer on a surface thereof. The developer carrier conveys the developer to a developing position opposite to the latent image bearer by moving the developer carrying member so as to develop the latent image carried by the latent image bearer. In a startup operation after a stop operation performed during a developing operation by the developer carrier, the developer carrying member is rotated for a predetermined time while the latent image bearer is set in a stopped state before starting a rotation.

20 Claims, 11 Drawing Sheets

IMAGE FORMING APPARATUS AND METHOD IN WHICH A DEVELOPER CARRYING MEMBER IS ROTATED FOR A PREDETERMINED TIME DURING A STARTUP OR REMOVAL OPERATION

CROSS-REFERENCE TO RELATED APPLICATION

The present application is based upon and claims the benefit of priority of Japanese Patent Application No. 2014-005705, filed on Jan. 16, 2014, the entire contents of which are incorporated herein by reference.

BACKGROUND OF THE INVENTION

1. Field of the Invention

The present invention generally relates to an image forming apparatus such as a copy machine, a printer, a facsimile, a multifunction peripheral of the aforementioned, etc.

2. Description of the Related Art

Generally, a developer carrier is used in an image forming apparatus, such as a copy machine, a printer, a facsimile, a multifunction peripheral, etc., to develop a latent image formed on a photoconductor, which is a latent image bearer. The developer carrier is arranged at a position facing the photoconductor so as to develop the latent image on the photoconductor by carrying the developer stored in a developer accommodating container and conveying the developer to a developing position.

Conventionally, there are suggested various structures to remove a developer that remains on the photoconductor when an operation of a developing unit is stopped during a developing operation in such an image forming apparatus. For example, Japanese Laid-Open Patent Application No. 2001-209277 suggests a structure of collecting a developer remaining on a photoconductor by a developer carrier after rotating the photoconductor to convey the developer to the position at which the developer carrier is arranged while changing the electrostatic characteristic of the developer remaining on the photoconductor.

However, if the photoconductor is driven and rotated to remove the remaining developer, there may occur a rotation abnormality of the photoconductor due to locking of a photoconductor drive motor, which is caused by a load fluctuation generated by the remaining developer.

Thus, it is desirous to suppress the occurrence of the rotation abnormality of the photoconductor during the removing operation of removing the developer remaining on the photoconductor, which condition is caused by a stopping operation during a developing operation, when performing a subsequent startup operation.

SUMMARY OF THE INVENTION

There is provided according to an aspect of the present invention an image forming apparatus including a latent image bearer that carries a latent image and a developer carrier including a developer carrying member that carries a developer on a surface thereof. The developer carrier conveys the developer to a developing position opposite to the latent image bearer by moving the developer carrying member so as to develop the latent image carried by the latent image bearer. In a startup operation after a stop operation performed during a developing operation by the developer carrier, the developer carrying member is rotated for a predetermined time while said latent image bearer is set in a stopped state before starting a rotation.

There is provided according to another aspect of the present invention an image forming apparatus including a latent image bearer that carries a latent image and a developer carrier including a developer carrying member that carries a developer on a surface thereof. The developer carrying member of the developer carrier is rotated to convey the developer to a developing position opposite to the latent image bearer so as to develop the latent image carried by the latent image bearer. In a startup operation of the image forming apparatus after a stop operation, the developer carrying member is rotated for a predetermined time while the latent image bearer is set in a stopped state before starting a rotation.

There is provided according to a further aspect of the present invention an image forming method performed by an image forming apparatus including a latent image bearer that carries a latent image and a developer carrier including a developer carrying member that carries a developer on a surface thereof. The image forming method includes: in a startup operation of said image forming apparatus, determining whether an immediately preceding stop operation of said image forming apparatus is a normal stop or an abnormal stop; when the immediately preceding stop operation is the abnormal stop, rotating the developer carrying member for a first predetermined time while the latent image bearer is set in a stopped state before starting a rotation; after the first predetermined time has passed, rotating the latent image bearer and charging a surface of the latent image for a second predetermined time; and after the second predetermined time has passed, rotating the latent image bearer; conveying the developer carried by the developer carrying member to a developing position opposite to the latent image bearer by moving the developer carrying member; and developing the latent image carried by the latent image bearer by the developer conveyed by the developer carrying member at the developing position.

Other objects, features and advantages of the present invention will become more apparent from the following detailed description when read in conjunction with the accompanying drawings.

The objects and advantages of the invention will be realized and attained by means of the elements and combinations particularly pointed out in the claims.

It is to be understood that both the foregoing general description and the following detailed description are exemplary and explanatory and not restrictive of the invention.

DETAILED DESCRIPTION OF THE EMBODIMENTS

A description will now be given, with reference to the drawings, of embodiments of the present invention. In the embodiments described below, it is assumed that the "abnormal stop" designates i) a stop due to an activation of an emergency stop control during a developing operation in an image forming apparatus, ii) a stop due to a power OFF of an image forming apparatus during a developing operation, etc. The emergency stop control is performed when it is determined that the image forming apparatus is set in an abnormal state during a developing operation, which may lead to a malfunction, such as, for example, a case where an opening/closing door is open during a developing operation. As a case where a power of the image forming apparatus is turned OFF during a developing operation, there may be a power failure, an interruption of a power supply breaker, an erroneous operation of a power supply switch by a user, etc.

<1. Hardware Structure of Image Forming Apparatus>

Figure 1:
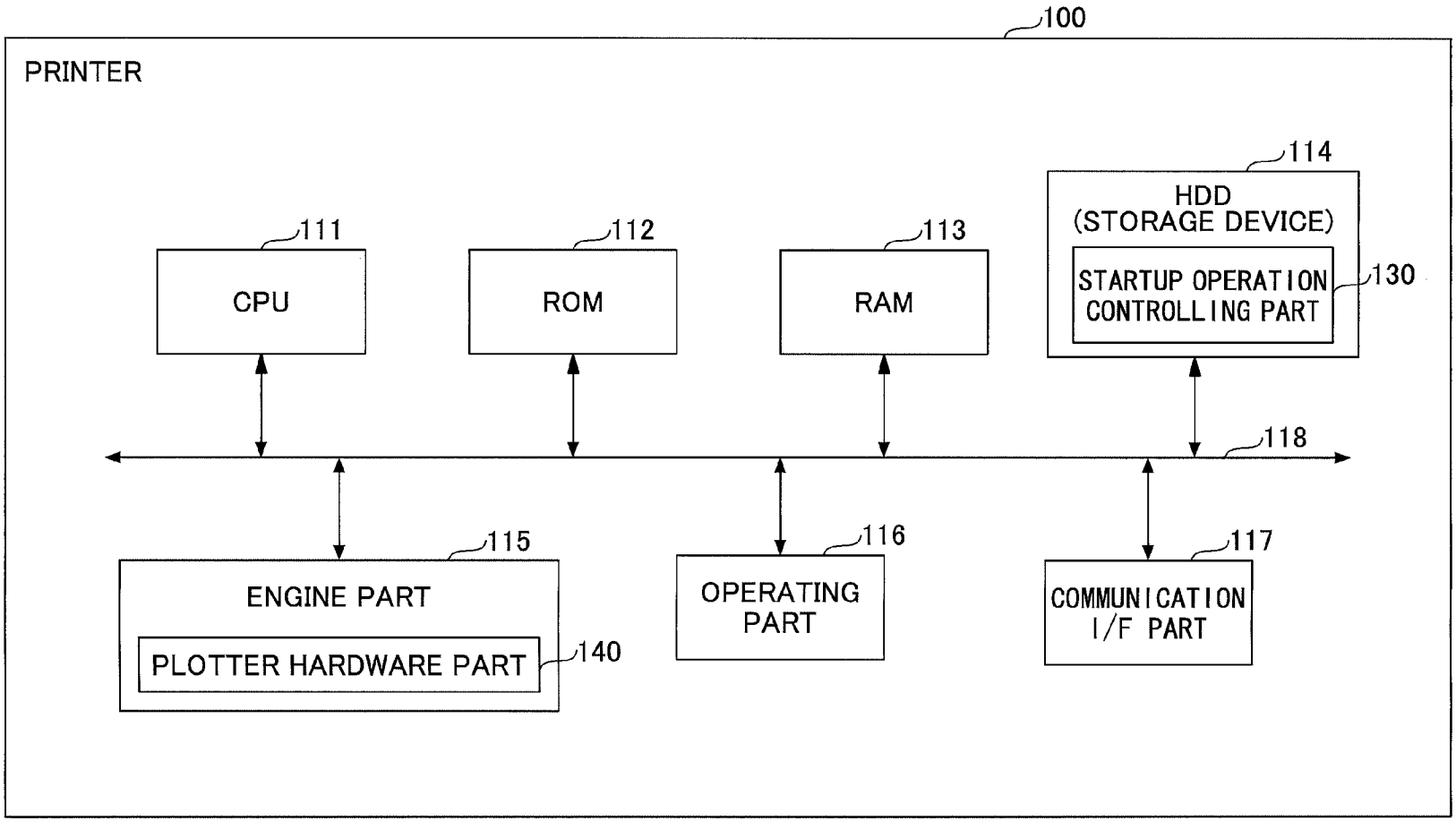
FIG. 1 is a block diagram of a hardware structure of an image forming apparatus according to an embodiment.

First, a description is given of a hardware structure of an image forming apparatus according to an embodiment. FIG. 1 is a block diagram of a hardware structure of an electrophotographic printer 100 (hereinafter, simply referred to as the "printer"), which is an example of the image forming apparatus according to the present embodiment.

As illustrated in FIG. 1, the printer 100 includes a CPU (computer) 111, ROM 112, RAM 113 and storage device 114 such as an HDD (Hard Disk Drive) or the like. The printer 100 further includes an engine part, operating part 116 and communication I/F part 117. These elements constituting the printer 100 are mutually connected through a bus 118.

The CPU 111 controls the entire printer 100 by executing various programs recorded in the ROM 112 or the storage device 114 using the RAM 113 as a work area. The CPU 111 also materializes various functions including a startup operation control function mentioned later.

The storage device 114, which is a non-volatile storage medium, records programs executed by the CPU 111 and various kinds of data. The programs recorded in the storage device 114 include a program executed by the CPU 111 to materialize the startup operation controlling part 130 that provides a startup operation control function mentioned later.

The engine part 115 is provided with hardware (a plotter hardware part 140) for materializing a printing function. Details of the plotter hardware part 140 will be mentioned later with reference to FIG. 2.

The operating part 116 is used when a user performs various operations, such as inputting various settings to cause the printer 100 to perform a printing function and inputting an instruction to cause the printer 100 to perform a printing function. The communication I/F 117 is an interface for communication with an external device (not illustrated in the figure).

<2. Outline Structure of Plotter Hardware>

Figure 2:
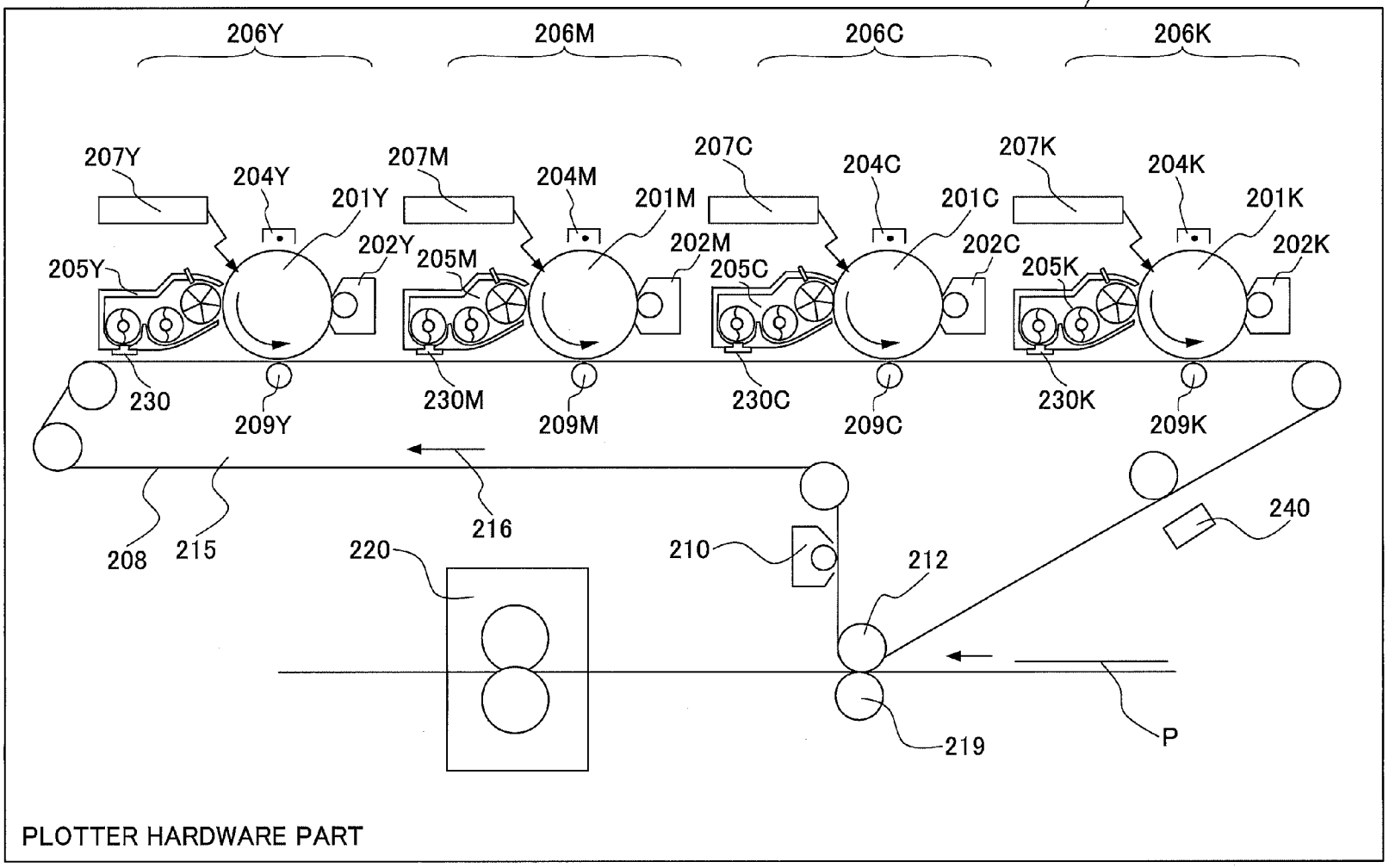
FIG. 2 is an illustration of a plotter hardware part.

A description is given below of an outline structure of the plotter hardware part 140 that constitutes the printer 100. FIG. 2 is an illustration of a structure of the plotter hardware part 140.

As illustrated in FIG. 2, the plotter hardware part 140 includes four toner image forming parts 206Y, 206M, 206C and 206K to create toner images in yellow, magenta, cyan and black (hereinafter, represented by Y, M, C and K)

The toner image forming parts 206Y, 206M, 206C and 206K use a Y toner, an M toner, a C toner and a K toner, respectively, but they have the same structure except for the usage of the different color toners. Thus, a description is given below of only the toner image forming part 206Y for creating a Y toner image as a representative of the four toner image forming parts 206Y, 206M, 206C and 206K.

The toner image forming part 206Y includes a drum-shaped photoconductor 201Y, which is a latent image bearer, a drum cleaning device 202Y, a discharging device (not illustrated), a charging device 204Y, a developing device 205Y, and an exposure device 207Y. The charging device 204Y charges the entire surface of the photoconductor 201Y at a uniform potential while the photoconductor 201Y is driven by a driving means (not illustrated) to rotate in a counterclockwise direction in the figure.

The surface potential of the photoreceptor 201Y charged by the charging device 204Y is hereinafter indicated as V0. The photoconductor 201Y carries an electrostatic latent image for Y by being scan-exposed by a laser light emitted by the exposure device 20. The surface potential of the electrostatic latent image portion of the photoconductor 201Y, which is scan-exposed by the laser light, is hereinafter indicated as V1. The electrostatic latent image for Y is developed to be a Y toner image by the developing device 205Y provided with the Y toner. Then, the Y toner image is transferred onto an intermediate transfer belt, which is an intermediate transfer member.

The drum cleaning device 202Y performs cleaning to remove the toner remaining on the surface of the photoconductor 201Y after being subjected to an intermediate transfer process. The discharging device discharges the residual electric charge of the photoconductor 201Y after the cleaning by the drum cleaning device 202Y. According to the discharging by the discharging device, the surface of the photoconductor 201Y is initialized to be prepared for a subsequent image forming operation.

Similarly in other toner image forming parts 206M, 206C and 206K, an M toner image, C toner image and K toner image are formed on the photoconductors 201M, 201C and 201K, and are transferred onto the intermediate transfer belt 208.

The exposing device 207Y, 207M, 207C and 207K, which are latent image forming units, project laser lights, which are emitted based on image information, onto the respective photoconductors 201Y, 201M, 201C and 201K in the toner image forming parts 206Y, 206M, 206C and 206K so as to expose the photoconductors 201Y, 201M, 201C and 201K with the respective laser lights. According to the exposure, the electrostatic latent images for Y, M, C and K are formed on the respective photoconductors 201Y, 201M, 201C and 201K.

An intermediate transfer unit 215 is arranged underneath the toner image forming parts 206Y, 206M, 206C and 206K. The intermediate transfer unit 215 includes the intermediate transfer belt 208 is an endless belt that rotates to move the toner images transferred thereon. The intermediate transfer unit 215 further includes four primary transfer bias rollers 209Y, 209M, 209C and 209K, a cleaning device 210 and a secondary transfer backup roller 212.

The intermediate transfer belt 208 rotates in a clockwise direction in the figure. The primary transfer bias rollers 209Y, 209M, 2090 and 209K sandwich the intermediate transfer belt 208 with the respective photoconductors 201Y, 201M, 201C and 201K so as to form primary transfer nip portions, respectively. In the primary transfer nip portions, the primary transfer bias rollers 209Y, 209M, 209C and 209K apply a transfer bias, which is a reverse polarity (for example, a plus bias voltage), to the backside of the intermediate transfer belt 208 (the inner surface of the loop). All of the rollers excluding the primary transfer bias rollers 209Y, 209M, 209C and 209K are electrically grounded.

In the process of sequentially passing through the primary transfer nip portions for Y, M, C and K with the rotation of the intermediate transfer belt 208, the Y, M, C, and K toner images on the photoconductors 201Y, 201M, 201C and 201K are primarily transferred onto the intermediate transfer belt 208 in an overlapping manner. Thereby, a four color overlapping toner image (hereinafter, referred to as the "4-color toner image") is formed on the intermediate transfer belt 208.

The secondary transfer backup roller 212 forms a secondary nip portion by sandwiching the intermediate transfer belt with a secondary transfer roller 219. The 4-color toner image formed on the intermediate transfer belt 208 is transferred onto a transfer paper P at the secondary nip portion.

A reflection type photosensor 240 is arranged to oppose to the intermediate transfer belt 208 in an area between the lowermost toner image forming part 206K and the secondary transfer nip portion so that the photosensor 240 outputs a signal corresponding to a reflectance of the surface of the intermediate transfer belt 208. Specifically, the photosensor 240 includes reflection-type photosensors for each color Y, M, C and K that are arranged in a line in a direction of depth in FIG. 2 so as to individually detect an image density of each color in the 4-color toner image.

A remaining toner, which has not been transferred to the transfer paper P, adheres to the intermediate transfer belt 208 after passing through the secondary transfer nip portion. The transfer remaining toner is removed from the intermediate transfer belt 208 by the cleaning device 210. In the secondary transfer nip portion, the transfer paper P is conveyed by being sandwiched between the intermediate transfer belt 208 and the secondary transfer roller 219 each of which rotates in a normal direction. The 4-color toner image is transferred to the surface of the transfer paper P conveyed out of the secondary transfer nip portion. The 4-color toner image is fixed by heat and pressure when the transfer paper P passes through an area between rotating rollers of the fixing device 220.

<3. Structure of Developing Device>

Figure 3:
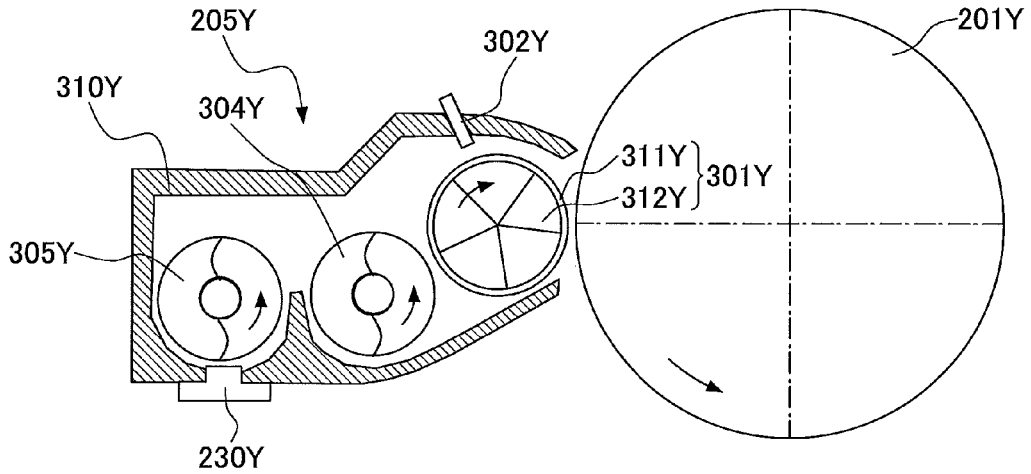
FIG. 3 is an enlarged cross-sectional view of a developing device.

A description is given below of the details of the structure of the developing device 205Y. FIG. 3 is an enlarged cross-sectional view of the developing device 205Y. The developing device 205Y includes a developing roller 301Y. A part of the circumferential surface of the developing roller 301Y is exposed outside through an opening part provided in a casing 310Y.

The developing roller 301Y, which is a developer carrying roller, includes a developing sleeve 311Y (developer carrying member) and a magnet roller 312Y. The developing sleeve 311Y is made of a non-magnetic pipe, and is rotatable by a driving means (not illustrated in the figure). The magnet roller 312Y is encircled by the developing sleeve 311Y, and does not rotate together with the rotation of the developing sleeve 311Y.

A certain amount of Y developer (not illustrated in the figure) is stored in the developing device. 205Y. The Y developer contains a magnetic carrier and a Y toner having a minus charging property.

The Y developer is agitated and conveyed by two conveyance screws 304Y and 305Y. Thereby, the Y toner contained in the Y developer is frictionally charged. Then, the Y developer is attached to the surface of the rotating developing sleeve 311Y by the magnetic force of the magnet roller 312, which is a magnetic field generating means in the developing sleeve 301Y, and is conveyed by the developing sleeve 311Y.

The Y developer is conveyed with a rotation of the developing sleeve 311Y and passes through a position opposite to a developing doctor 30, which is a restricting member. The thickness of the Y developer is restricted by the developing doctor 30, and, then, the Y developer is conveyed to a developing position opposite to the photoconductor 201Y.

In the developing position, between the developing sleeve 311Y to which the developing bias of a negative polarity is applied and the electrostatic latent image portion (surface potential=V1) on the photoconductor 201Y, a developing potential is applied to the Y toner to electrostatically move the Y toner having a negative polarity from the side of the developing sleeve 311Y to the side of the electrostatic latent image. Additionally, between the developing sleeve 311Y and the uniformly charged portion (surface portion (surface potential=V0)) on the photoconductor 201Y, a non-developing potential is applied to the Y toner to electrostatically move the Y toner having a negative polarity from the side of the surface portion to the side of the developing sleeve 311Y. It is assumed that the developing bias Vb having a negative polarity is supplied to from a power supply source (not illustrated in the figure).

The Y toner contained in the Y developer on the developing sleeve 311Y is separated from the developing sleeve 311Y due to an action of the developing potential, and is transferred to the electrostatic latent image portion of the photoconductor 201Y. According to the transfer, the latent image on the photoconductor 201Y is developed and changed into a Y toner image. The Y developer of which the Y toner is consumed by the development is returned to the interior of the casing 310Y with the rotation of the development sleeve 311Y.

As illustrated in FIG. 2, the developing device 205Y has a toner density sensor 230Y, which is constituted by a magnetic permeability sensor. The toner density sensor 230Y outputs a voltage corresponding to the magnetic permeability of the Y developer stored in the developing device 205Y. Because the magnetic permeability of the developer exhibits an excellent collation with the toner density of the developer, the toner density sensor 230Y outputs a voltage corresponding to the toner density. The value of the output voltage is sent to a toner supply controlling part (not illustrated in the figure).

The toner supply controlling part includes a storage unit, such as a RAM, in which a target value (Vtref for Y) of the voltage output from the toner density sensor for Y is stored. The storage unit also stores data of Vtref for M, C and K, which represent target values of voltages output from the toner density sensors mounted on other developing devices.

In the developing device 205Y, the value of the voltage output from the toner density sensor 230Y is compared with Vtref, which is a target vale of the output voltage for Y so as to cause the Y toner density supply device (not illustrated in the figure) to drive for a time corresponding to a result of the comparison. Thereby, the replenishing Y toner can be supplied to the developing device 205.

Accordingly, by the control of the drive of the Y toner density supply device, an appropriate amount of the Y toner is supplied to the Y developer of which the Y toner density is decreased with the developing operation. Thus, the density of Y toner contained in the Y developer stored in the developing device 205Y can be maintained within a predetermined range. For example, the toner density is maintained within a range from 5 weight % to 9 weight % in a developer that is a combination of a toner having a particle diameter of 6 μm and a carrier having a particle diameter of 35 μm.

<4. Event Occurring at Developing Position at Abnormal Stop Time>

Figure 4A:
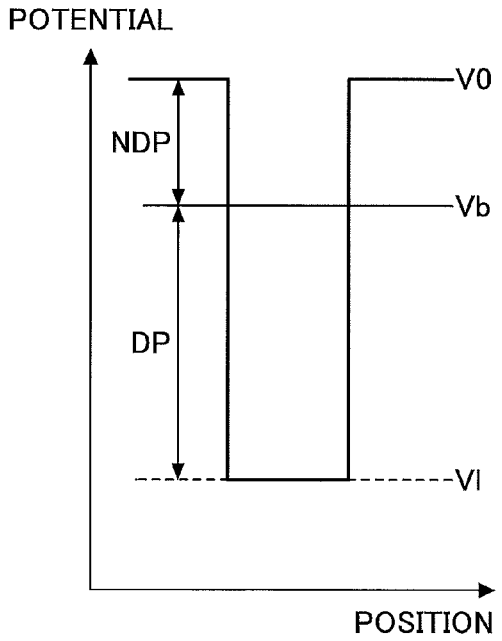
FIGS. 4A and 4B are illustrations illustrating potential relationships between a photoconductor and a developing sleeve at a developing position.

A description is given below of an event which occurs at the developing position when an operation of the printer 100 having the above-mentioned structure is stopped due to an abnormality (hereinafter, referred to as the "abnormal stop"). In a state where a developing operation is carried out normally, at the developing position, the surface potential V0 of the uniformly charged portion (surface portion) of the photoconductor 201Y, the developing bias Vb having a negative polarity and the surface potential V1 of the electrostatic latent image portion have a relationship as illustrated in FIG. 4A.

On the other hand, if an operation of the printer 100 is stopped due to an abnormality and a power supply is interrupted, the developing bias Vb drops to the ground potential because a power supply to a power board, which has applied the developing bias, is interrupted. On the other hand, the surface potential V0 of the uniformly charged portion (surface portion) and the surface potential V1 of the electrostatic latent image portion on the photoconductor 201Y are almost unchanged and maintained at the values before the abnormal stop. As a result, the relationship in potential between the photoconductor 201Y and the developing sleeve 311Y at the developing position in the case of the abnormal stop is as illustrated in FIG. 4B.

Figure 4B:
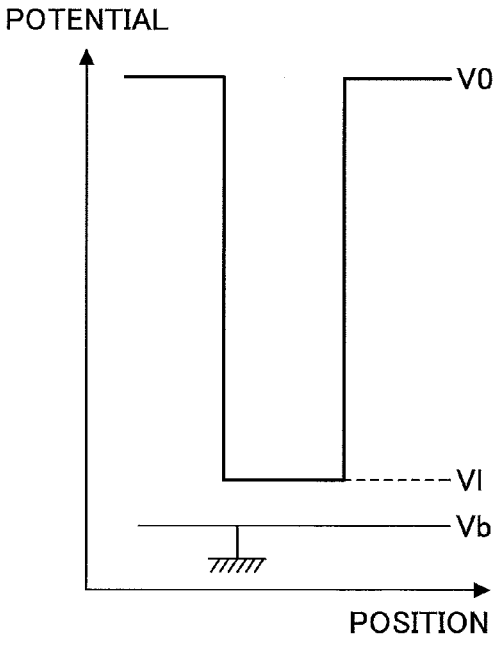

In the state illustrated in FIG. 4B, an extremely large electric field is generated between the developing sleeve 311Y, which has become a ground potential, and the uniformly charged portion (surface potential=V0) of the photoconductor 201Y to move the carrier having a positive polarity from the developing sleeve 311Y to the surface side of the photoconductor 201.

Here, at the time of the abnormal stop, the power supply to a drive motor, which is a driving unit to rotate the photoconductor 201Y and the developing sleeve 311Y, and the power supply to the power board, which has supplied the developing bias Vb, are interrupted almost simultaneously. On the other hand, after the developing bias Vb dropped to the ground potential and the condition of the potentials is set to the relationship illustrated in FIG. 4B, the photoconductor 201Y and the developing sleeve 311Y continue to rotate due to an inertial force for a time of about several hundred milliseconds.

Figure 5:
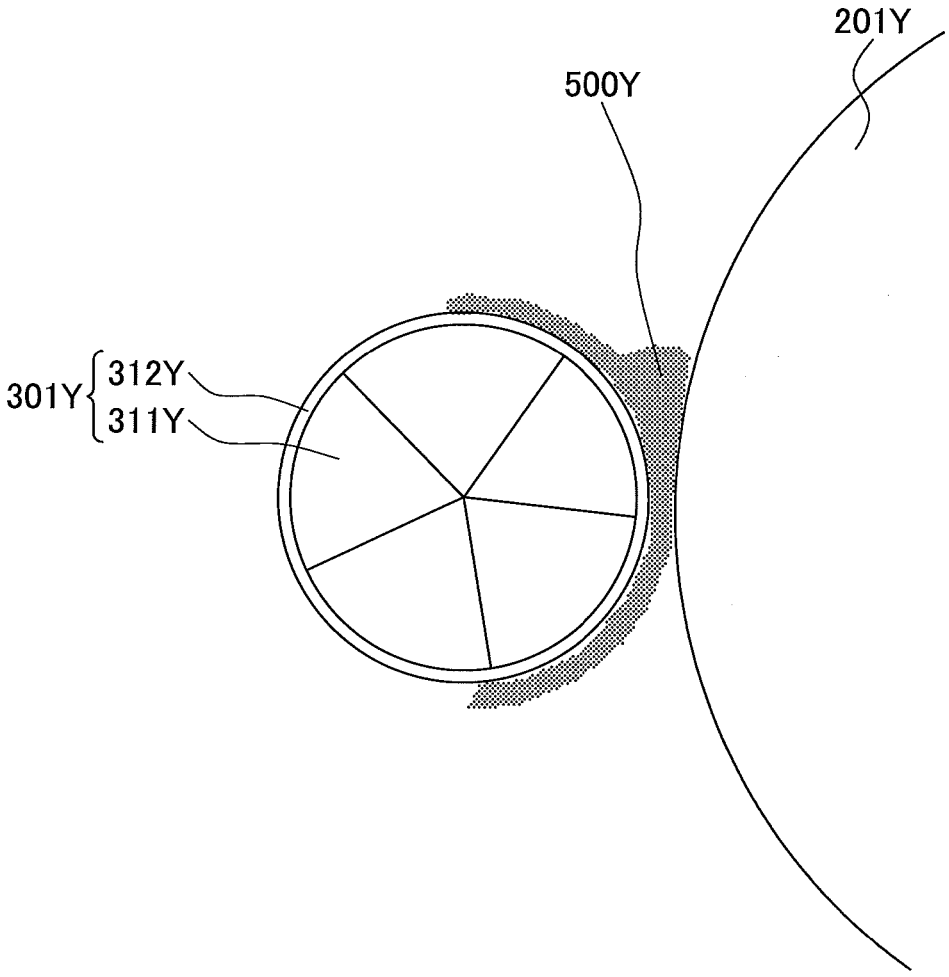
FIG. 5 is an illustration of a developer for explaining an event that occurs when an abnormal stop is performed.

At this time, because the extremely large electric field is generated at the developing position to move the carrier having a positive polarity from the developing sleeve 311Y to the surface side of the photoconductor 201Y, an adhesion of the carrier to the photoconductor 201 occurs. As a result, as illustrated in FIG. 5, a developer pool 500Y in which the developer is accumulated is formed on an upstream side of the developing position.

Note that an amount of the developer pool 500Y becomes larger as the potential of the uniformly charged portion (surface portion (surface potential=V0)) of the photoconductor 201Y is higher (larger) because the intensity of the electric field that electrostatically moves the carrier having a positive polarity from the developing sleeve 311Y to the surface side of the photoconductor 201Y is increased.

<5. Functional Structure of Startup Operation Controlling Function>

Figure 6:
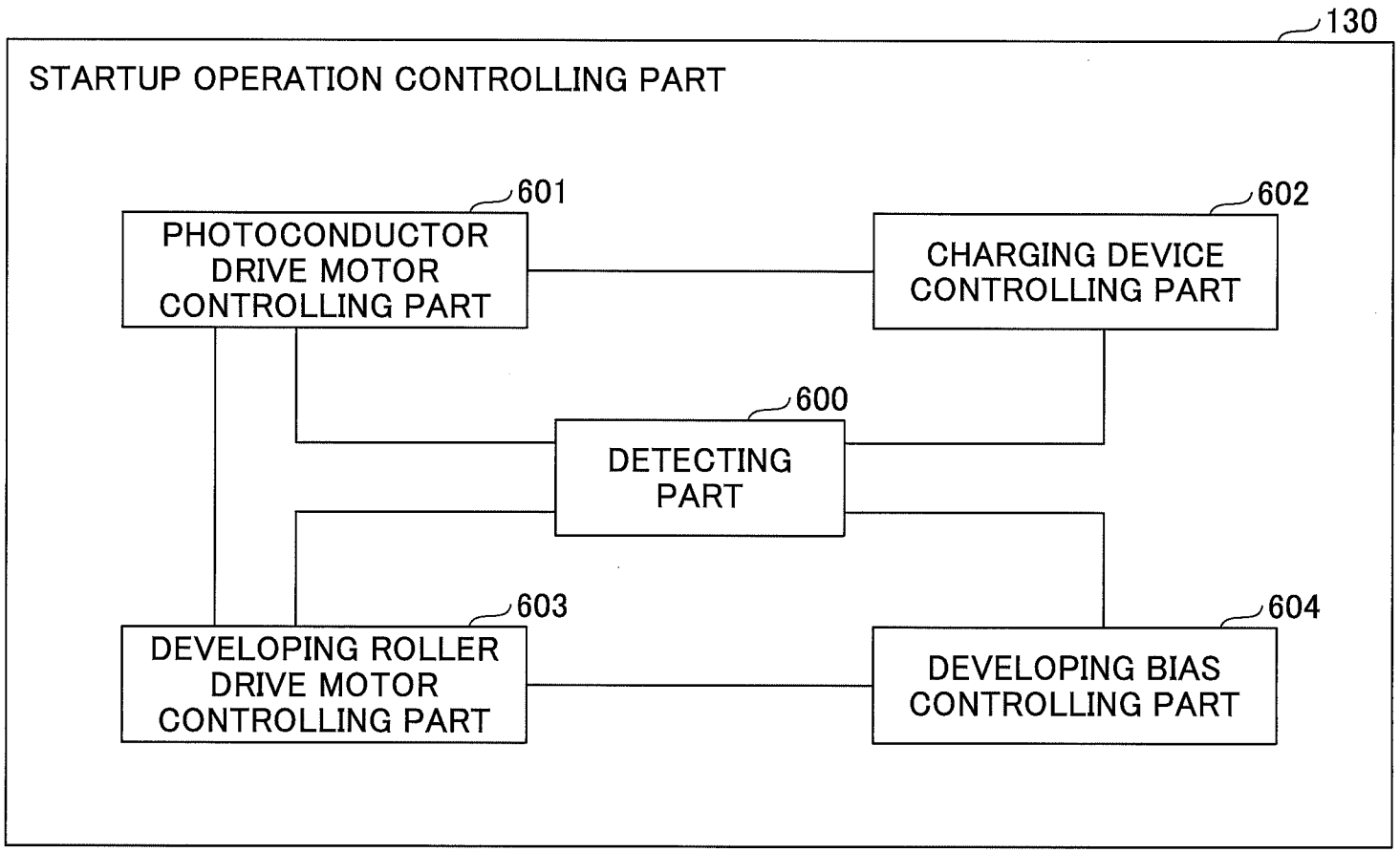
FIG. 6 is a block diagram of a startup operation controlling part.

A description is given below of a functional structure of the startup operation controlling part 130 in the printer 100, which suppresses an occurrence of a rotation abnormality of the photoconductor 201Y while removing the above-mentioned developer pool 500Y. FIG. 6 is a block diagram illustrating a functional structure of the startup operation controlling part 130 in the printer 100.

As illustrated in FIG. 6, the startup operation controlling part 130 includes a detecting part 600, a photoconductor drive motor controlling part 601, a charging device controlling part 602, a developing roller drive motor controlling part 603 and a developing bias controlling part 604.

The detecting part 600 determines whether an immediately preceding stop operation was "normal stop" or "abnormal stop". Specifically, the detecting part 600 sets a flag during the developing operation and resets the flag after ending the developing operation. The detecting part 600 refers to the flag when performing a startup operation after a stop operation to determine whether the stop was "normal stop" or "abnormal stop". A result of the comparison is sent to the photoconductor drive motor controlling part 601, the charging device controlling part 602, the developing roller drive motor controlling part 603 and the developing bias controlling part 604.

The photoconductor drive motor controlling part 601 controls a photoconductor drive motor (not illustrated in the figure), which is a drive unit of rotating the photoconductor 201Y, to drive/stop.

The charging device controlling part 602 controls a charging operation to the photoconductor 201Y by the charging device 104 to start/end. Note that the photoconductor derive motor controlling part 601 and the charging device controlling part 602 are configured to operate in synchronization with each other. Additionally, each of the photoconductor drive motor controlling part 601 and developing roller drive motor controlling part 603 is configured to operate in response to an operating condition of the other.

<6. Startup Operation After Abnormal Stop>

A description will be given of a startup operation performed by the startup operation controlling part 130 of the printer 100 after an abnormal stop. First, as a target for comparison, a description is given of a typical startup operation performed in a popular printer.

<6.1 Startup Operation After Abnormal Stop in General Printer>

Figure 7:
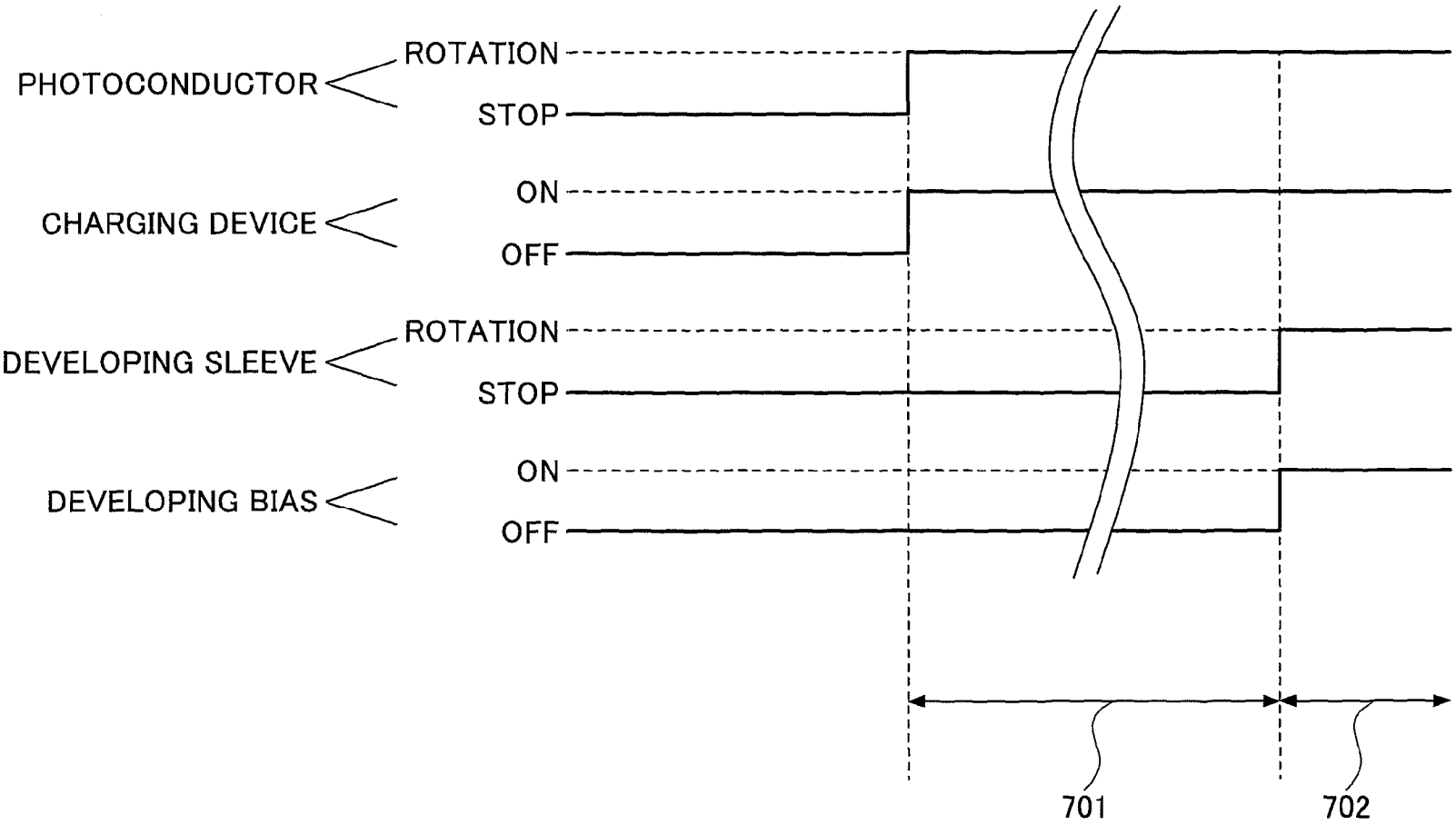
FIG. 7 is a time chart illustrating an operation timing of each part during a startup operation performed by a printer.

FIG. 7 is a time chart indicating operation timings of a photoconductor, charging device, developing sleeve and developing bias in a startup operation after an abnormal stop in a general printer. As illustrated in FIG. 7, in the startup operation after an abnormal stop in a popular printer, the photoconductor and the charging device start operations first, and, then, a rotation of the developing sleeve and an application of the developing bias are started after a fixed time period (section 701) has passed.

In this case, there is no change in the developer pool 500Y on the upstream side of the developing position, which is formed due to the abnormal stop during the section 701 where the photoconductor rotates first in the state where the developing sleeve is stopped.

Thereafter, when the rotation of the development sleeve is started (in section 702 in FIG. 7), the developer accumulated in the developer pool 500Y is pressed into the developing position all at once. As a result, a load fluctuation is generated, which causes the photoconductor drive motor to lock, and, thereby, a rotation abnormality of the photoconductor occurs.

Especially, if a stepping motor is used as the photoconductor drive motor, which is a drive unit for driving the photoconductor, the locking of the photoconductor drive motor occurs more easily when the developer accumulated in the developer pool 500Y is pressed into the developing position all at once and a load fluctuation is generated.

<6.2 Startup Operation After Abnormal Stop in Printer 100>

A description is given below of a startup operation after an abnormal stop performed by the startup operation controlling part 130 of the printer 100 after according to the present embodiment. In the printer according to the present embodiment, if the detecting part 600 determines that an immediately preceding stop operation is the "abnormal stop", a startup operation different from the above-mentioned startup operation after an abnormal stop in the popular printer is performed in order to suppress an occurrence of a rotation abnormality of the photoconductor 201Y.

Figure 8:
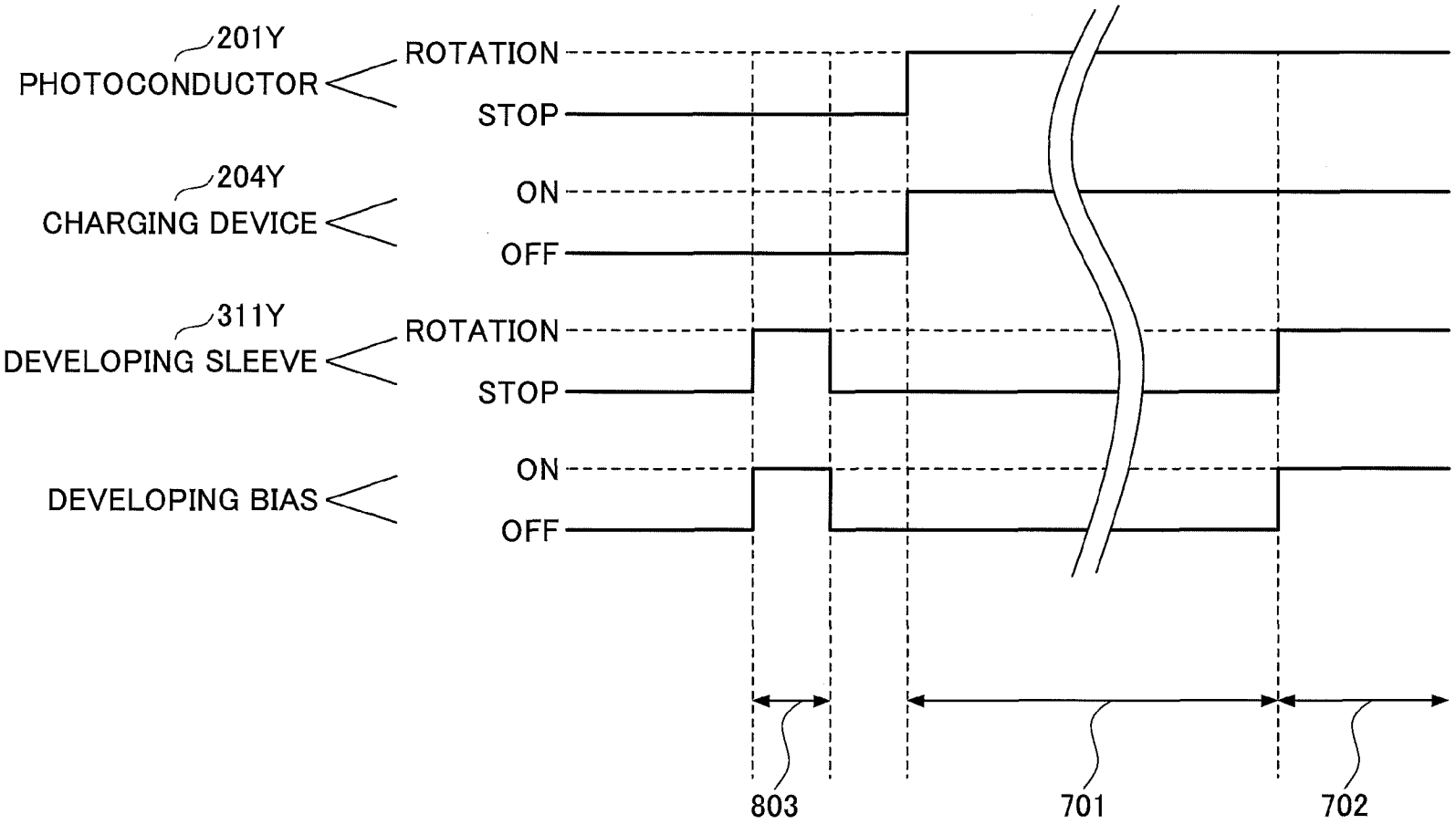
FIG. 8 is a time chart illustrating an operation timing of each part during a startup operation performed by the image forming apparatus according to the embodiment.
Figure 9:
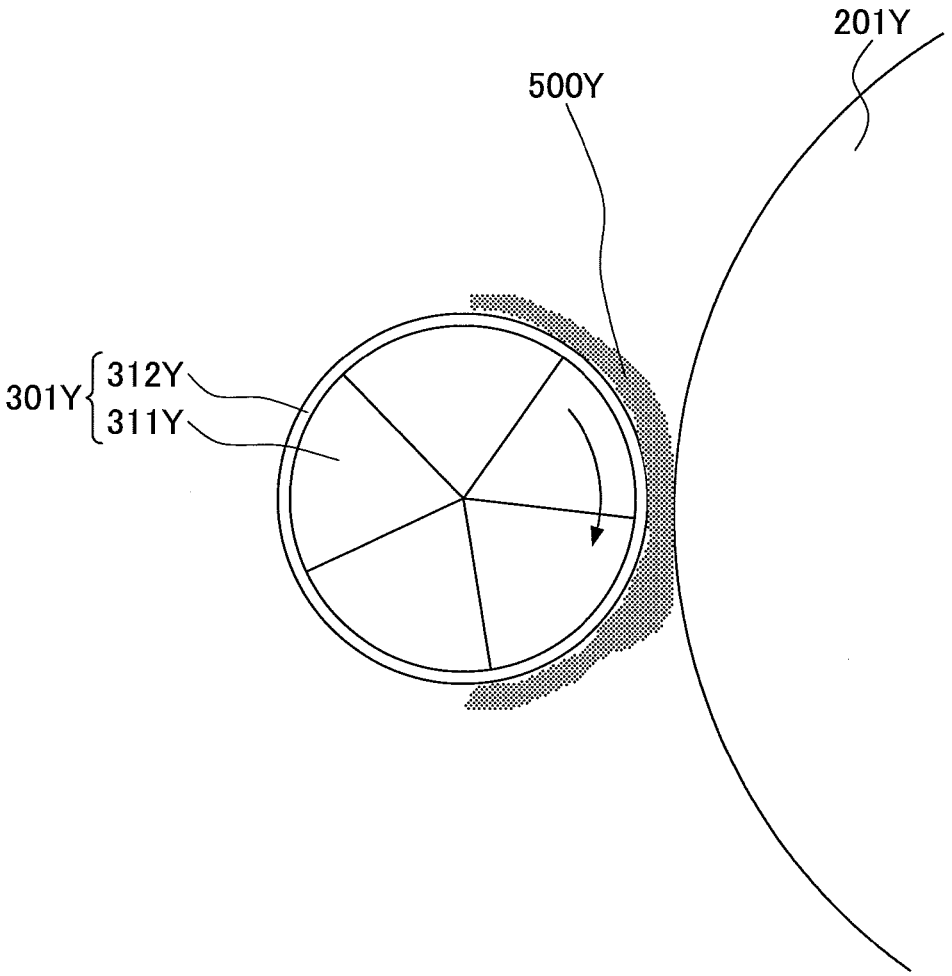
FIG. 9 is an illustration of a developer for explaining an event that occurs during a startup operation after an abnormal stop.

FIG. 8 is a time chart indicating operation timings of the photoconductor 201Y, charging device 204Y, developing sleeve 311Y and developing bias in the startup operation after an abnormal stop performed by the startup operation controlling part 130 of the printer according to the present embodiment. As illustrated in FIG. 8, in the printer according to the present embodiment, the developing sleeve 311 is rotated for a predetermined time period (section 803) in a stopped state before the rotation of the photoconductor 201Y and the charging by the charging device 204 are started. Additionally, the developing bias is applied to the developing sleeve 311Y for the predetermined time period (section 803).

If the developing sleeve 311Y is rotated in a state where the photoconductor 201Y is stopped, the developer accumulated in the developer pool 500Y flows and passes through the developing position (the closest point between the developing sleeve and the photoconductor). Thereby, the amount of the developer in the developer pool 500Y is reduced. In this circumstance, because the photoconductor 201Y is not rotated yet, there is no possibility that the photoconductor drive motor locks due to a load fluctuation.

Here, in order to reduce the developer in the developer pool 500Y to the extent that the photoconductor drive motor does not lock when the photoconductor drive motor is driven in the section 701, it is necessary to rotate the developing sleeve 311Y by more than a fixed angle (for example, a half rotation) to carry the developer in the developer pool 500Y to a downstream side.

Although the time period (section 803) for rotating the developing sleeve 311Y by more than the fixed angle depends on the characteristic of the developer and the photoconductor drive motor, an environment, etc., the section 803 is preferably about 20 milliseconds to about 1 second. Note that an upper limit is set to the time of rotation of the developing sleeve 311Y because there is a possibility of generating an uneven wear of the photoconductor 201Y due to local abrasion of the photoconductor 201Y if the developing sleeve 311Y is rotated for a long time in a state where the photoconductor 201Y is stopped. Additionally, it is not desirable from the viewpoint of user convenience to spent a long time in the startup operation due to the rotation of the developing sleeve 311Y.

Note that if the process speed (a linear velocity of the photoconductor surface) of the printer 100 is set to 440 mm/s, the diameter of the development sleeve 311Y is set to 30 mm, and the development linear velocity ratio is set to 1.5, a time required by the developing sleeve 311Y to rotate a half rotation is about 71 milliseconds. If such a time period is taken, it can contribute to the prevention of locking of the photoconductor drive motor to that extent of a range almost the same as the time required by the startup operation after an abnormal stop in the above-mentioned popular printer.

Note that the amount of the developer in the developer pool 500Y may be grasped previously so as to calculate a time period required for reducing the amount of developer to the extent that the photoconductor drive motor does not lock. The thus-calculated time period is stored in a memory of the printer 100, and the section 803 may be determined based on the stored time period.

<6.3 Reason for Applying Developing Bias in Startup Operation After Abnormal Stop in Printer 100>

As mentioned above, in the printer 100 according to the present embodiment, the developing sleeve 311Y is rotated for the predetermined time (section 803) and a developing bias is applied during the startup operation after an abnormal stop in the state where the photoconductor 201 is stopped. However, the photoconductor drive motor can be prevented from being locked by merely rotating the developing sleeve 311Y without applying a developing bias. The reason for applying a developing bias in synchronization with the rotation of the developing sleeve 311 is mentioned below.

Because the dark attenuation speed of the photoconductor 201Y is slow, it takes a considerably long time (several minutes to several ten minutes) until the surface potentials V0 and V1 fall below the developing bias Vb. Thus, the surface potential V0 of the uniformly charged portion (surface portion) and the surface potential V1 of the electrostatic latent image portion of the photoconductor 201Y are almost unchanged from the state at the time of abnormal stop in the printer 100.

Accordingly, if the developing sleeve 311Y is rotated without applying a developing bias in the section 803, similar to the time of an abnormality stop, an extremely large electric field is generated, which electrostatically moves the carrier having a positive polarity from the developing sleeve 311Y to the photoconductor 201Y. As a result, an amount of the developer flowing through the developing position (closest position between the developing sleeve and the photoconductor) becomes small and, thereby, the amount of the developer stored in the developer pool 500Y hardly reduces. Additionally, because the carrier adheres to the surface of the photoconductor 201Y, if the photoconductor 201Y is rotated in the section 701, the carrier adhering to the surface of the photoconductor 201 is input into a drum cleaning device 202Y and a cleaning device 210 in a subsequent stage. As a result, there may be a problem of an occurrence of an adverse reaction that the photoconductor 201Y and the intermediate transfer belt 208 are damaged.

On the other hand, if a developing bias is applied in synchronization with the rotation of the developing sleeve 311Y in the section 803, the photoconductor drive motor can be reliably prevented from being locked, and also such an adverse reaction can be prevented from being occurred.

An advantage of applying a developing bias in synchronization with the rotation of the developing sleeve 311Y in the section 803 can be acquired even in a case where a considerable time has passed after an abnormal stop of the printer 100 and until a startup operation is performed.

Figure 10A:
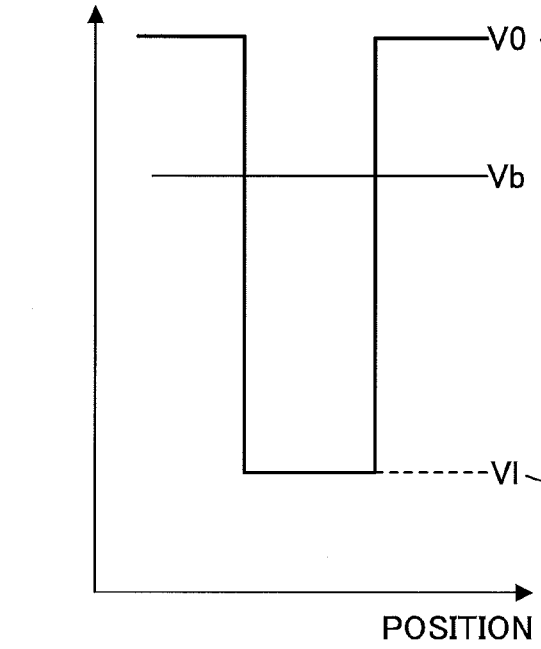
FIGS. 10A and 10B are illustrations illustrating potential relationships between the photoconductor and the developing sleeve at a developing position after a long time has passed from an abnormal stop.
Figure 10B:
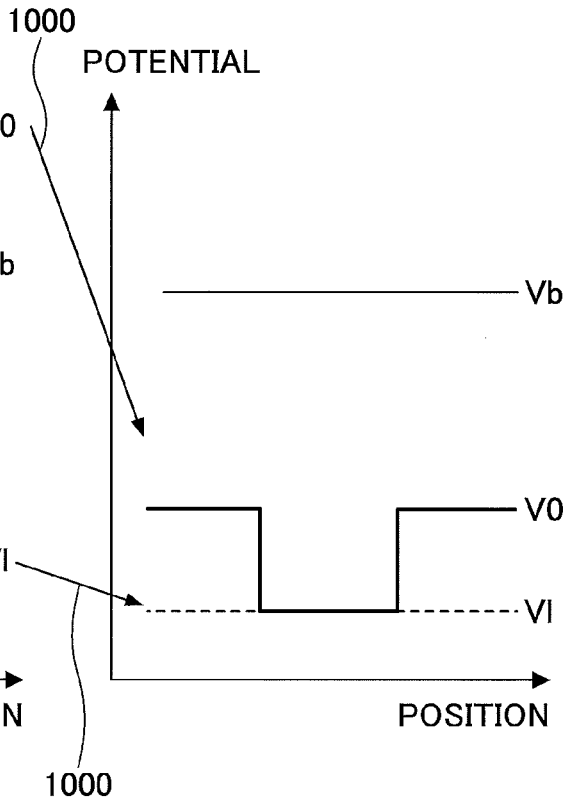

If a considerable time has passed after an abnormal stop of the printer 100 and until a startup operation is performed, the surface potential of the photoconductor 201 may be dark-attenuated (refer to an arrow 1000 indicated between FIGS. 10A and 10B), and the surface potential falls below the developing bias Vb. In this condition, an electric field, which causes the Y toner having a negative polarity to move from the side of the developing sleeve 311Y to the side of the electrostatic latent image, is generated in an area between the developing sleeve 311Y and the electrostatic latent image portion (surface potential=V1) on the photoconductor 201Y. Thus, the Y toner having a negative polarity merely adheres to the surface of the photoconductor 201Y, and the above-mentioned adverse reaction does not occur.

As mentioned above, it is more desirable to apply a development bias in synchronization with the rotation of the developing sleeve 311Y in the startup operation after an abnormal stop.

<7. Flow of Startup Operation by Startup Operation Controlling Part>

Figure 11:
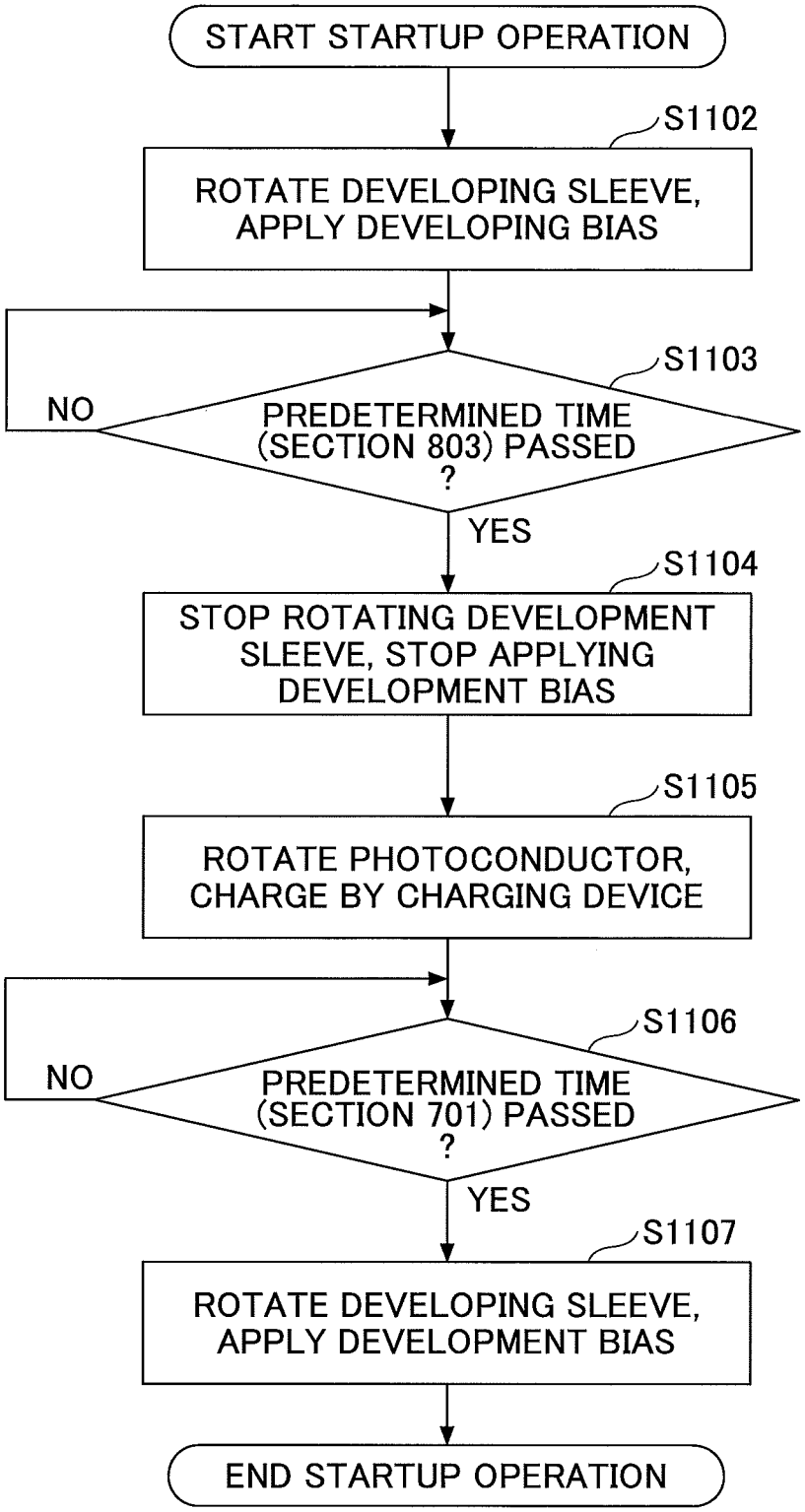
FIG. 11 is a flowchart of a startup operation controlled by a startup operation controlling part.

A description will be given of a flow of a startup operation performed by the startup operation controlling part 130. FIG. 11 is a flowchart illustrating a flow of a basic startup operation performed by the startup operation controlling part 130.

First, in step S1102, the development roller drive motor controlling part 603 sends an instruction to drive the developing roller drive motor to rotate the developing sleeve 311Y. Additionally, the developing bias controlling part 604 sends an instruction to apply a developing bias to the developing sleeve 311Y.

In step S1103, the startup operation controlling part 130 determines whether a predetermined time (section 803) has passed after the instruction of driving the development roller drive motor and the instruction of applying a developing bias were sent. If it is determined in step S1103 that the predetermined time (section 803) has not passed yet, the startup operation controlling part 130 waits for passage of the predetermined time (section 803).

On the other hand, if it is determined in step S1103 that the predetermined time (section 803) has passed, the startup operation controlling part 130 proceeds to step S1104. In step S1104, the developing roller drive motor controlling part 603 sends an instruction to stop the developing roller drive motor to stop the rotation of the developing sleeve 311Y. Additionally, the developing bias controlling part 604 sends an instruction to end the application of the developing bias to the developing sleeve 311Y.

Then, in step S1105, the photoconductor drive motor controlling part 601 sends an instruction to drive the photoconductor drive motor to rotate the photoconductor 201Y. Additionally, the charging device controlling part 602 sends an instruction to start charging by the charging device 204Y.

Then, in step S1106, the startup operation controlling part 103 determines whether a predetermined time (section 701) has passed after the instruction of driving the photoconductor drive motor and the instruction of starting the charging were sent. If it is determined in step S1106 that the predetermined time (section 701) has not passed yet, the startup operation controlling part 103 waits for passage of the predetermined time (section 701).

On the other hand, if it is determined in step S1106 that the predetermined time (section 701) has passed, the startup operation controlling part 130 proceeds to step S1107. In step S1107, the developing roller drive motor controlling part 603 sends an instruction to drive the developing roller drive motor to rotate the developing sleeve 311Y. Additionally, the developing bias controlling part 604 sends an instruction to start applying a developing bias to the developing sleeve 311Y. Thereby, the startup operation after an abnormal stop is completed.

Figure 12:
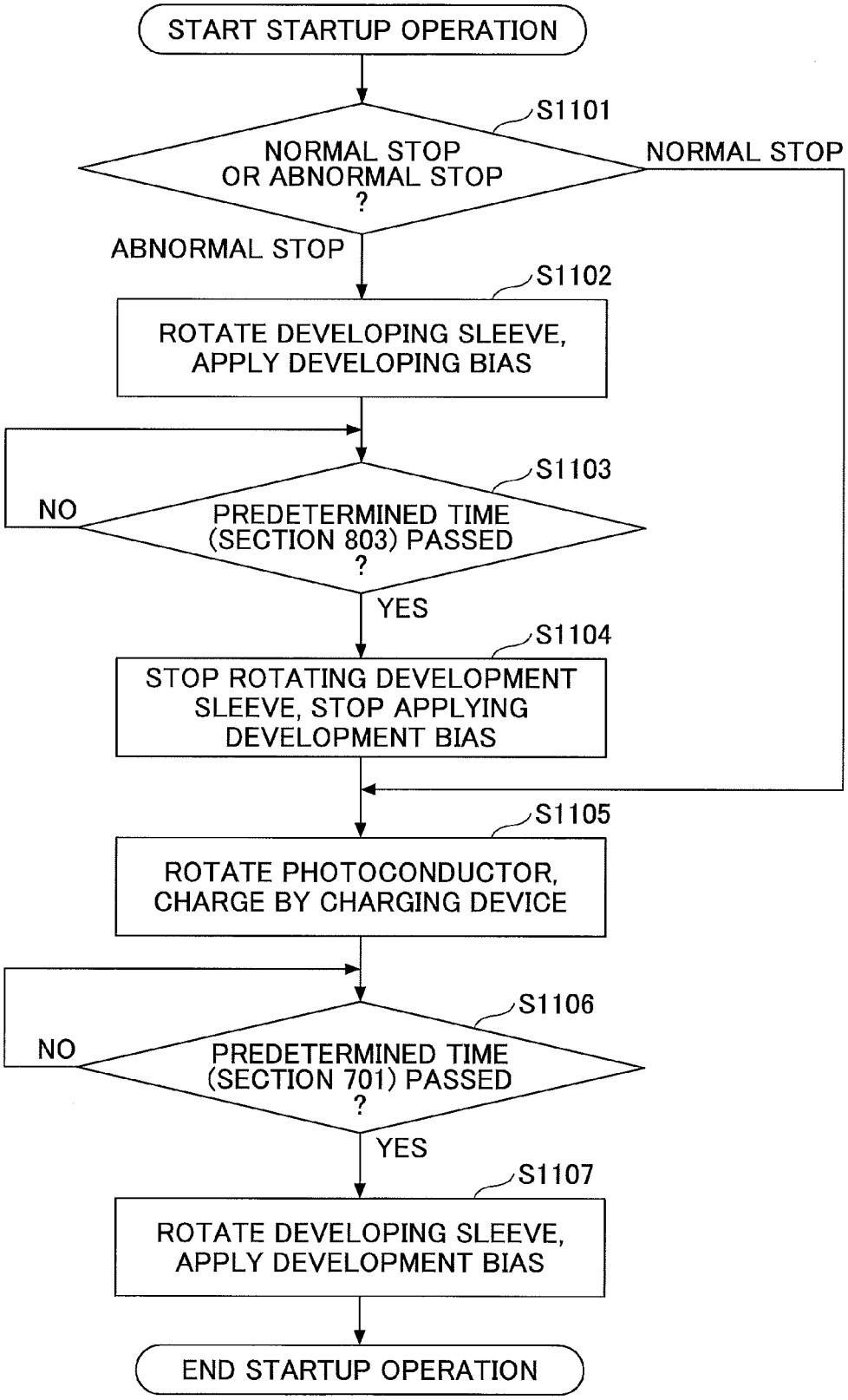
FIG. 12 is a flowchart of another startup operation controlled by the startup operation controlling part.

A description is given below, with reference to another example of the startup operation. FIG. 12 is a flowchart of another example of the startup operation performed by the startup operation controlling part 130. The startup operation illustrated in FIG. 12 is the same as the startup operation illustrated in FIG. 11 except for a determining process performed by the detecting part 600, and duplicate descriptions of the steps will be omitted.

In the startup operation illustrated in FIG. 12, the process of step S1101 is first performed by the detecting part 600 of the startup operation controlling part 130. That is, in step S1101, the detecting part 600 determines whether the immediately preceding stop operation is a normal stop or an abnormal operation. If the detecting part 600 determines in step S1101 that the immediately preceding step is an abnormal stop, the process proceeds to step S1102 to perform the above-mentioned startup operation explained with reference to FIG. 11. Thereby, the startup operation after an abnormal stop is completed.

On the other hand, if the detecting part 600 determines in step S1101 that the immediately preceding stop operation is a normal stop, the process proceeds to step S1105 without performing the process of steps S1102 through S1104 to perform the above-mentioned process of steps S1105 through S1107. Thereby, the startup operation after a normal stop is completed.

<8. Summary>

As mentioned above, in the printer 100 according to the present embodiment, the developing sleeve is rotated for the predetermined time in the stopped state before the rotation of the photoconductor is started, and a developing bias is applied in synchronization with the rotation of the developing sleeve for the predetermined time.

That is, the image forming apparatus according to the present embodiment rotates the developing sleeve and applies a developing bias for the predetermined time in the state where the photoconductor is stopped. Accordingly, an amount of the developer in the developer pool created due to an abnormal stop can be reduced before the rotation of the photoconductor is started.

As a result, it becomes possible to avoid an occurrence of a rotation abnormality of the photoconductor due to a load fluctuation caused by a remaining developer when the photoconductor is started to rotate in the startup operation after an abnormal stop.

In the present embodiment, a DC motor or a stepping motor can be used as the photoconductor drive motor, which is a drive unit for rotating the photoconductor 201Y. However, as mentioned above, the stepping motor has a characteristic of being more easily locked than the DC motor when a load fluctuation occurs due to the developer accumulated in the developer pool 500Y being pushed into the developing position (the closest position between the developing sleeve and the photoconductor) all at once. Thus, the present embodiment is especially effective to the case where a stepping motor is used as the photoconductor drive motor, which is a drive unit for rotating the photoconductor 201Y.

Moreover, according to startup operation illustrated in FIG. 12, different startup operations are performed depending on whether the immediately preceding stop operation is a normal stop or an abnormal stop. However, the startup operation is not limited to such operations, and the startup operation after a normal stop may be the same as the startup operation after an abnormal stop.

However, if the developing sleeve 311Y is rotated in the state where the photoconductor 201Y is stopped, a specific portion of the photoconductor 201Y is scrubbed by the developer even though it is in an extremely short time. Thus, it is desirous to perform the startup operation illustrated in FIG. 8 only after an abnormal stop.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. An image forming apparatus, comprising:

a latent image bearer that carries a latent image; and a developer carrier including a developer carrying member that carries a developer on a surface thereof, the developer carrier conveying the developer to a developing position opposite to said latent image bearer by moving said developer carrying member so as to develop the latent image carried by the latent image bearer, wherein in a startup operation that is performed after a determination that a stop operation performed during a developing operation by said developer carrier was caused by an abnormality, said developer carrying member is rotated for a first predetermined time while said latent image bearer is set in a stopped state before starting a rotation; and wherein after the rotation of the developer carrying member has stopped for another predetermined time while the latent image bearer is rotated, the developer carrying member is rotated a second time while the latent image bearer continues to rotate.

2. The image forming apparatus as claimed in claim 1, wherein a developing bias is applied to said developer carrying member in synchronization with the rotation of said developer carrying member for the first predetermined time.

3. The image forming apparatus as claimed in claim 1, wherein said developer carrying member is rotated at least a half rotation while said latent image bearer is set in the stopped state before starting a rotation.

4. An image forming apparatus, comprising:

a latent image bearer that carries a latent image; and a developer carrier including a developer carrying member that carries a developer on a surface thereof, the developer carrier conveying the developer to a developing position opposite to said latent image bearer by moving said developer carrying member so as to develop the latent image carried by the latent image bearer, wherein in a removal operation of said image forming apparatus after a stop operation, said removal operation to remove remaining developer that remains on the latent image bearer after the stop operation, said remaining developer remaining on the latent image bearer above a closest point between the latent image bearer and the developer carrying member, said developer carrying member is rotated for a predetermined time while said latent image bearer is set in a stopped state before starting a rotation, so as to cause the remaining developer to pass through the closest point between the latent image bearer and the developer carrying member.

5. The image forming apparatus as claimed in claim 4, wherein a developing bias is applied to said developer carrying member in synchronization with the rotation of said developer carrying member for the predetermined time.

6. The image forming apparatus as claimed in claim 4, wherein said developer carrying member is rotated at least a half rotation while said latent image bearer is set in the stopped state before starting a rotation.

7. An image forming method performed by an image forming apparatus including a latent image bearer that carries a latent image and a developer carrier including a developer carrying member that carries a developer on a surface thereof, the image forming method comprising:

performing a startup operation after a determination that a stop operation performed during a developing operation by said developer carrier was caused by an abnormality, wherein in said startup operation said developer carrying member is rotated for a first predetermined time while said latent image bearer is set in a stopped state before starting a rotation; and rotating, after the rotation of the developer carrying member has stopped for another predetermined time while the latent image bearer is rotated, the developer carrying member a second time while the latent image bearer continues to rotate, and conveying the developer carried by said developer carrying member to a developing position opposite to said latent image bearer by moving said developer carrying member.

8. The image forming method as claimed in claim 7, further comprising applying a developing bias in synchronization with the rotating said developer carrying member for the first predetermined time.

9. The image forming method as claimed in claim 7, wherein said developer carrying member rotates by at least a half rotation when rotating said developer carrying member for the first predetermined time while said latent image bearer is set in the stopped state before starting a rotation.

10. The image forming apparatus as claimed in claim 2, wherein after the bias has stopped being applied to the developing carrying member, a developing bias is applied to the developer carrying member a second time.

11. The image forming apparatus as claimed in claim 1, wherein a surface of the latent image bearer is charged while the developer carrying member is rotated the second time while the latent image bearer continues to rotate.

12. The image forming apparatus as claimed in claim 10, wherein a surface of the latent image bearer is charged while the developer carrying member is rotated the second time and the developing bias is applied to the developer carrying member the second time.

13. The image forming apparatus as claimed in claim 1, wherein the first predetermined time period is determined based on an amount of pooled developer.

14. The image forming apparatus as claimed in claim 1, further comprising a stepping motor for rotating the latent image bearer.

15. The image forming apparatus as claimed in claim 1, wherein the startup operation is performed only after a determination that a stop operation performed during the developing operation by the developer carrier was caused by an abnormality.

16. An image forming apparatus, comprising:

a latent image bearer that carries a latent image; and a developer carrier including a developer carrying member that carries a developer on a surface thereof, the developer carrier conveying the developer to a developing position opposite to said latent image bearer by moving said developer carrying member so as to develop the latent image carried by the latent image bearer, the developer carrier and the latent image bearer being rotated from upward to a facing region at which the developer carrier and the latent image bearer face each other, wherein in a removal operation of said image forming apparatus after a stop operation, said developer carrying member is rotated from upward to the facing region for a first predetermined time while said latent image bearer is set in a stopped state before starting a rotation; and wherein after the rotation of the developer carrying member has stopped for another predetermined time while the latent image bearer is rotated, the developer carrying member is rotated a second time while the latent image bearer continues to rotate.

17. The image forming apparatus as claimed in claim 16, wherein said removal operation is an operation to remove developer that remains upward of the region after the stop operation.

18. The image forming apparatus as claimed in claim 16, wherein a developing bias is applied to said developer carrying member in synchronization with the rotation of said developer carrying member for the first predetermined time.

19. The image forming apparatus as claimed in claim 16, wherein said developer carrying member is rotated at least a half rotation while said latent image bearer is set in the stopped state before starting a rotation.

20. The image forming apparatus as claimed in claim 16, wherein the first predetermined time period is determined based on an amount of pooled developer.

* * * * *